US010406658B2

(12) United States Patent
MacDonald

(10) Patent No.: US 10,406,658 B2
(45) Date of Patent: Sep. 10, 2019

(54) OPEN-ENDED RATCHET WRENCH

(71) Applicant: Jeffrey Dean MacDonald, Victoria (CA)

(72) Inventor: Jeffrey Dean MacDonald, Victoria (CA)

( * ) Notice: Subject to any disclaimer, the term of this patent is extended or adjusted under 35 U.S.C. 154(b) by 919 days.

(21) Appl. No.: 14/395,937

(22) PCT Filed: Apr. 29, 2013

(86) PCT No.: PCT/CA2013/000423
§ 371 (c)(1),
(2) Date: Oct. 21, 2014

(87) PCT Pub. No.: WO2013/163731
PCT Pub. Date: Nov. 7, 2013

(65) Prior Publication Data
US 2015/0082949 A1 Mar. 26, 2015

(30) Foreign Application Priority Data

Apr. 30, 2012 (CA) ..... 2775551
Feb. 19, 2013 (CA) ..... 2806944

(51) Int. Cl.
*B25B 13/08* (2006.01)
*B25B 13/46* (2006.01)
*B25B 23/00* (2006.01)

(52) U.S. Cl.
CPC ..... *B25B 13/463* (2013.01); *B25B 13/08* (2013.01); *B25B 23/0035* (2013.01)

(58) Field of Classification Search
CPC ... B25B 13/463; B25B 13/08; B25B 23/0035; B25B 13/46
USPC ..... 81/63.1, 62
See application file for complete search history.

(56) References Cited

U.S. PATENT DOCUMENTS

| | | | |
|---|---|---|---|
| 38,914 | A | 6/1863 | Bichaedsok |
| 861,524 | A | 7/1907 | Lalonde |
| 1,350,315 | A | 8/1920 | Katzmarek |
| 2,107,568 | A | 2/1938 | Haist |
| 2,521,419 | A | 9/1950 | Sellers |
| 2,527,033 | A | 10/1950 | Rogers et al. |
| 2,578,686 | A | 12/1951 | Fish |
| 2,636,411 | A | 4/1953 | Wood |
| 2,660,910 | A | 12/1953 | Sellers |
| 2,757,564 | A | 8/1956 | Reaves |
| 3,504,579 | A | 4/1970 | Harlan |
| 4,441,387 | A | 4/1984 | Hendricks |
| 4,562,757 | A | 1/1986 | Furey |
| 4,631,990 | A | 12/1986 | Hughes |

(Continued)

FOREIGN PATENT DOCUMENTS

| | | | | |
|---|---|---|---|---|
| BE | 565497 A | | 3/1958 | |
| CN | 201922377 U | * | 8/2011 | ..... B25B 13/16 |
| DE | 102009024689 A1 | | 12/2009 | |

OTHER PUBLICATIONS

Office Communication for European Patent Application No. 13785317.2 dated Aug. 8, 2016 (2 pages).

(Continued)

*Primary Examiner* — Monica S Carter
*Assistant Examiner* — Katina N. Henson

(57) ABSTRACT

An open-ended ratchet wrench having interchangeable jaws and selectable free rotation of the jaws.

20 Claims, 20 Drawing Sheets

(56) References Cited

U.S. PATENT DOCUMENTS

| | | | | |
|---|---|---|---|---|
| 5,090,273 | A * | 2/1992 | Fossella | B25B 13/44 81/57.11 |
| 5,282,830 | A * | 2/1994 | Reynolds | B25B 13/46 81/58.2 |
| 6,155,140 | A * | 12/2000 | Tsai | B25B 13/107 81/58.2 |
| 7,188,550 | B2 | 3/2007 | Tsai | |
| 7,987,747 | B2 * | 8/2011 | Ross | B25B 13/463 81/62 |
| 2006/0090607 | A1 * | 5/2006 | Tsai | B25B 13/463 81/58.2 |
| 2008/0264219 | A1 * | 10/2008 | Hsieh | B25B 13/04 81/467 |
| 2010/0269639 | A1 * | 10/2010 | Sroka | B25B 13/463 81/58.2 |

OTHER PUBLICATIONS

Office Communication for European Patent Application No. 13785317.2 dated Nov. 24, 2015 (1 page).
Office Communication for European Patent Application No. 13785317.2 dated Dec. 8, 2016 (5 pages).
Office Communication regarding Allowance for European Patent Application No. 13785317.2 dated Mar. 22, 2016 (38 pages).
Office Communication regarding European Supplementary Search Report for European Patent Application No. 13785317.2 dated Nov. 5, 2015 (5 pages).
Office Communication for European Patent Application No. 17183560.6 dated Dec. 6, 2017 (16 pages).

* cited by examiner

OPEN-ENDED RATCHET WRENCH

FIELD OF THE INVENTION

This invention relates to hand tools and, more particularly, to open-ended ratchet wrenches.

BACKGROUND OF THE INVENTION

Known open-ended ratchet wrenches include those disclosed in the following U.S. Pat. No. 7,188,550, Tsai, Mar. 13, 2007, Open end adjustable spanner; U.S. Pat. No. 6,155,140, Tsai, Dec. 5, 2000, Ratchet wrench; U.S. Pat. No. 4,631,990, Hughes, Dec. 30, 1986, Open-ended ratchet wrench; U.S. Pat. No. 4,441,387, Hendricks, Apr. 10, 1984, Open end ratchet wrench; U.S. Pat. No. 3,504,579, Harlan, Apr. 7, 1970, Open end ratchet wrench; U.S. Pat. No. 2,757,564, Reaves, Aug. 7, 1956, Broken circle ratchet wrench; U.S. Pat. No. 2,660,910, Sellers, Dec. 1, 1953, Ratchet wrench; U.S. Pat. No. 2,636,411, Wood, Apr. 28, 1953, Open end ratchet wrench; U.S. Pat. No. 2,527,033, Rodgers et al., Oct. 24, 1950, Ratchet wrench; U.S. Pat. No. 2,521,419, Sellers, Sep. 5, 1950, Ratchet-actuated open-end wrench; and U.S. Pat. No. 1,350,315, Katzmarek, Aug. 24, 1920, Wrench.

SUMMARY OF THE INVENTION

In one aspect, the present invention provides an open-ended ratchet wrench assembly for use in rotating rotatable fittings, the wrench assembly including: a plurality of interchangeable wrench heads, each wrench head having: a head arcuate mating feature; and a fitting engagement opening; and a wrench body having: a body arcuate mating feature for mating engagement with the head arcuate mating feature of one of the wrench heads when the wrench head is in a working position, so as to permit rotational movement of the wrench head relative to the wrench body about an axis of rotation defined by the arcuate mating features, while impeding movement of the wrench head in one direction along the axis of rotation and movement of the wrench head laterally with respect to the axis of rotation; and a cover affixed to the wrench body and resiliently biased in a head retention position in which the cover overlies one of the wrench heads in the working position so as to impede movement of the wrench head in the other direction along the axis of rotation, the cover hand manipulable from the head retention position, in a plane of movement to which the axis of rotation is substantially normal, so as to permit the installation and removal of wrench heads in the working position; and a ratchet assembly permitting rotation of the wrench head in the working position relative to the wrench body in one direction about the axis of rotation and impeding rotation in the other direction.

The ratchet assembly may be manually releasable whereby when the ratchet assembly is released the wrench head in the working position is permitted to rotate relative to the wrench body in either direction about the axis of rotation.

The ratchet assembly may include: multiple teeth arrayed about the periphery of each of the wrench heads; and two pawls each having a pawl end configured for engagement with the teeth, and each pawl resiliently biased with respect to the wrench body so as to tend to bring the pawl end into engagement with the adjacent periphery of the wrench head in the working position. Each pawl may have a pivot end opposite the pawl end and the two pivot ends may be pivotally mounted to the wrench head. Each pawl may be longitudinally extending and the pivot ends may be mounted proximate to one another such that the pawls together define a general V configuration; and a manually operable pawl spreader may be interposed between the pawls in the vicinity of the pivot ends, for use in user controlled disengagement of the pawls from the teeth so as to permit the wrench head in the working position to rotate relative to the wrench body in either direction about the axis of rotation. The pawl spreader may be manually rotatable and may have a variable lateral dimension adjacent the pawls such that manual rotation of the pawl spreader in a release direction brings a larger lateral dimension of the pawl spreader into contact with the pawls, thus spreading the pawls. The pawls may have projections and the pawl spreader may have two opposite facing planar surfaces that engage the projections, wherein the larger lateral dimension is provided by the relative angling of the planar surfaces during manual rotation of the pawl spreader, whereby the resilient biasing of each pawl with respect to the wrench body tends to cause the pawl spreader to rotate to an unreleased position once the user ceases manipulating the pawl spreader.

Each pawl may be resiliently biased with respect to the wrench body by a spring interposed between the pawl and the wrench body.

The wrench body may be longitudinally extending and the hand manipulable movement of the cover may be linear and generally aligned with the longitudinal extent of the wrench body. The wrench body may have a slot therethrough; and the cover may be affixed to the wrench body by means of a cover sub-member extending through the slot, wherein the cover may be moved by hand manipulation of the cover on one side of the wrench body or by manipulation of the cover sub-member on an opposite side of the wrench body. The cover may be resiliently biased in the head retention position by a spring within the slot.

The fitting engagement opening of each wrench head may include two opposed planar surfaces suitable for engaging fittings with conventional parallel outward facing planar surfaces.

The head arcuate mating feature of each wrench head may include an arcuate ridge and the body arcuate mating feature may include an arcuate channel.

It is a general object of the present invention to provide an open-ended ratchet wrench in which the wrench head may rotate freely from contact by the pawls on its teeth, allowing the wrench head to be easily slipped off tightened hoses and other objects of the like.

It is a further object of the present invention to provide an open-ended ratchet wrench in which the wrench head is largely exposed in order to be able to attach to, and detach from, a nut or bolt head through a broad range of angles.

It is still another object of the present invention to provide an open-ended ratchet wrench in which wrench heads of various sizes are readily interchangeable

SUMMARY OF THE DRAWINGS

FIG. 12 is an exploded perspective view of the embodiment shown in FIG. 7, with the view towards the working end of the embodiment and with jaws not shown for clarity.

DETAILED DESCRIPTION WITH REFERENCE TO THE DRAWINGS

Figure 1:
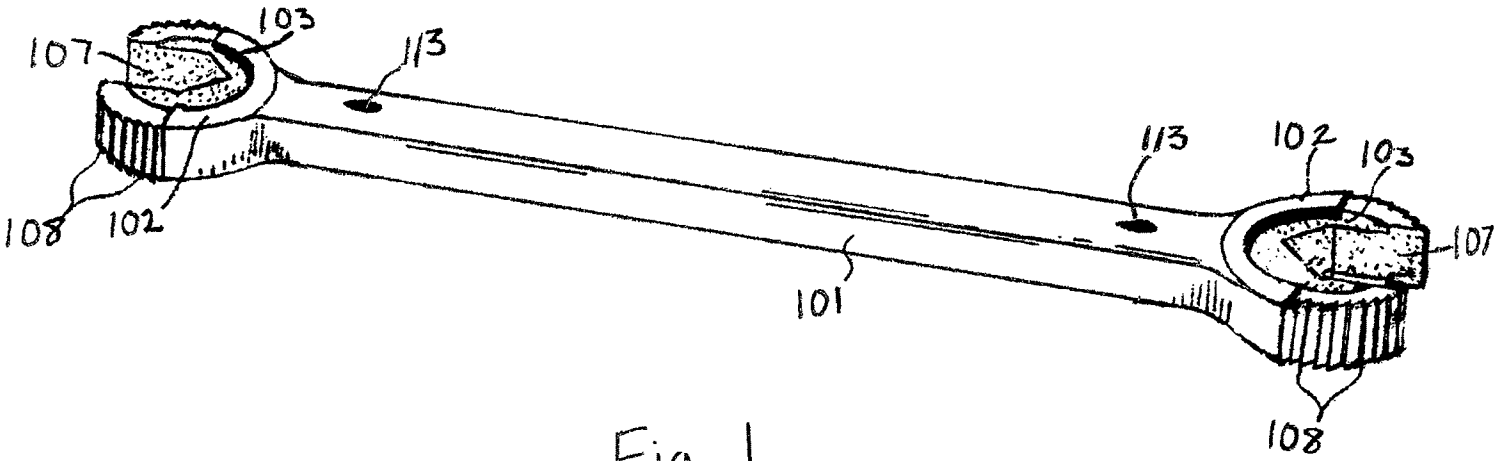
FIG. 1 is a perspective view of a first wrench embodiment of the present invention.
Figure 2:
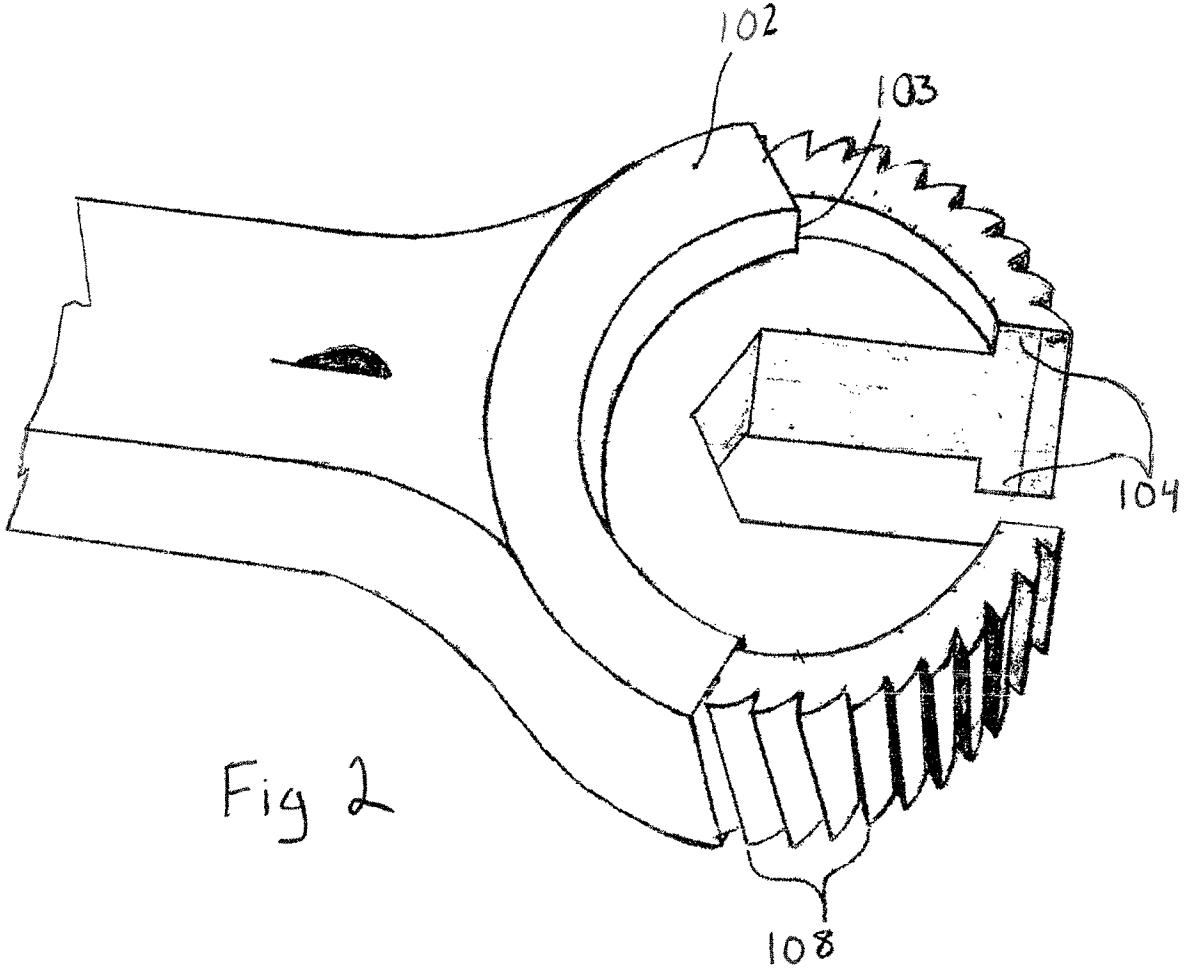
FIG. 2 is a perspective view of an end of the first wrench embodiment shown in FIG. 1.
Figure 3:
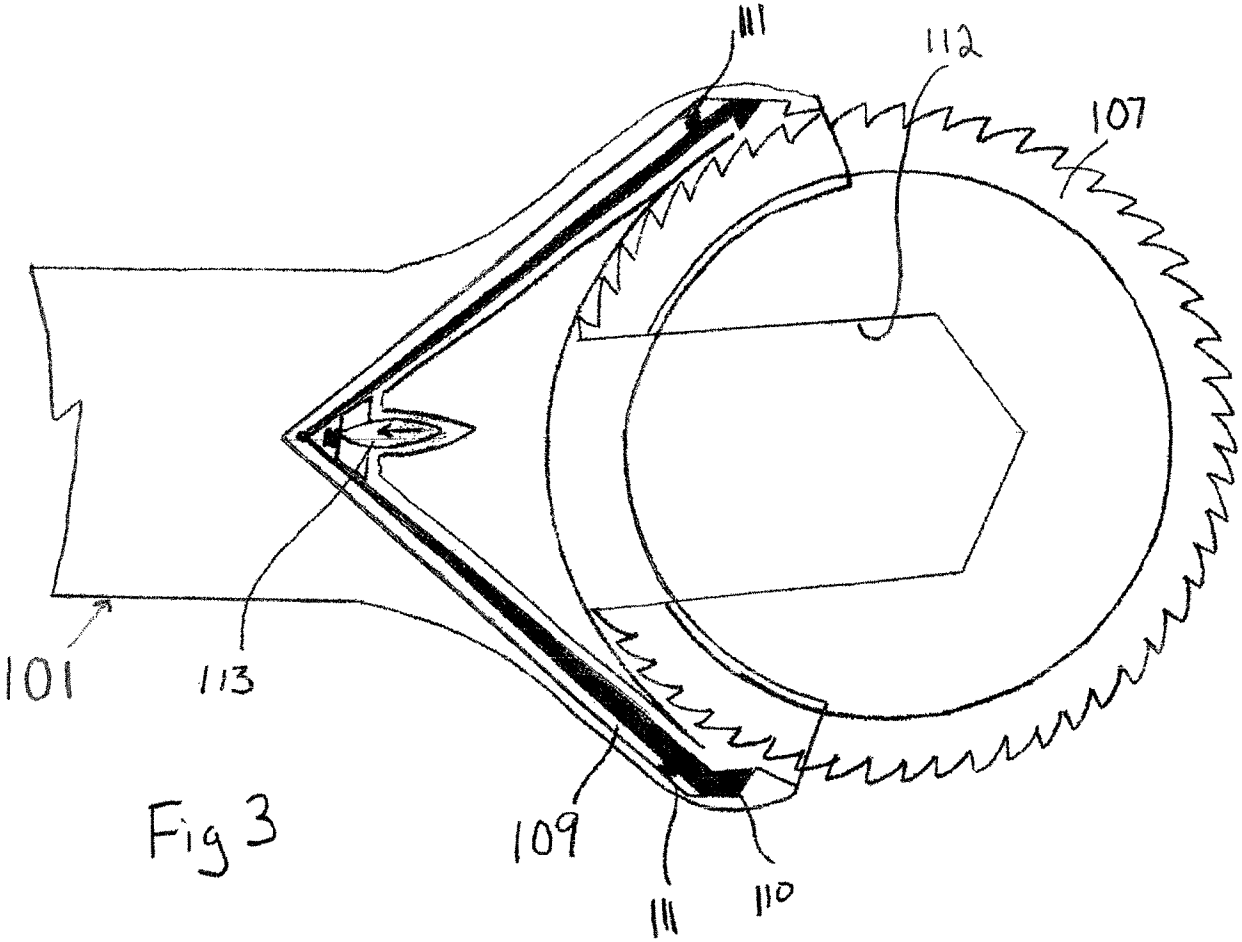
FIG. 3 is a partially transparent plan view of an end of the first wrench embodiment shown in FIG. 1, showing the pawls spread apart.

As shown in FIGS. 1 to 6, a first wrench embodiment of the present invention includes: a handle or elongated wrench body 101 having opposite end proportions each forming a "C"-shaped "C" channel 102. The "C" channel 102 forms an intermediate space and an annular recess 103 communicating with and extending around the circumferential flange on the ratchet wrench head 107 sprocket. Each channel communicates with, and holds firmly, a flange 104 comprising the outer rim and teeth 108 of the sprocket, as best shown in FIG. 2. The annular recess 103 is defined by the corresponding flange 104.

The elongated wrench body 101 may be horizontally split at each end by way of a hinged body segment, which is releasably connected to the main body and includes each one half of channel 102 at each end. Said hinged segment may be held in place by a sliding clamp. The ratchet wrench head 107 is rotatably held by the channel 102 in its rotatable sliding engagement in the corresponding annular recess 103 and by the corresponding flange 104. The periphery of each ratchet wrench head 107 is formed with a flange 104 and ratchet teeth 108. A cavity 109 is formed in the wrench body 101 and extends into the channel 102 at each end of the wrench. In each cavity 109, there is mounted a pawl 110 which is biased by a spring 111 toward engagement with the ratchet teeth 108. The two pawls 110 are substantially diametrically spaced apart to ensure that at least one pawl 110 will engage a ratchet tooth 108 in any rotational position of the ratchet wrench head 107.

Each ratchet wrench head 107 includes a radial slot 112 configured to operatively engage the fitting that the user desires to rotate (e.g., a nut, the head of a bolt. a fitting on an hydraulic hose or the like).

Figure 4:
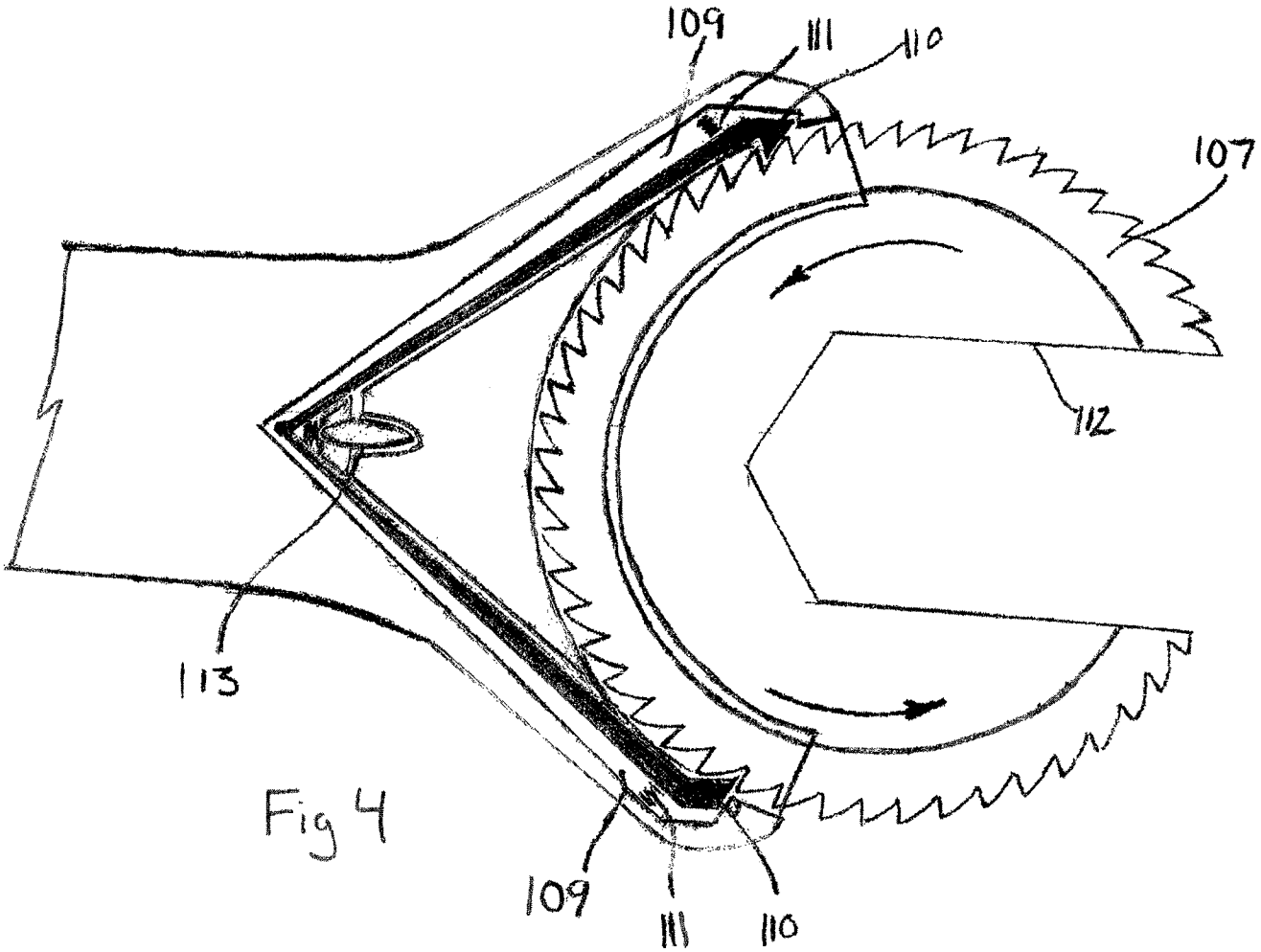
FIG. 4 is a partially transparent plan view of an end of the first wrench embodiment shown in FIG. 1, showing the pawls engaged.
Figure 5:
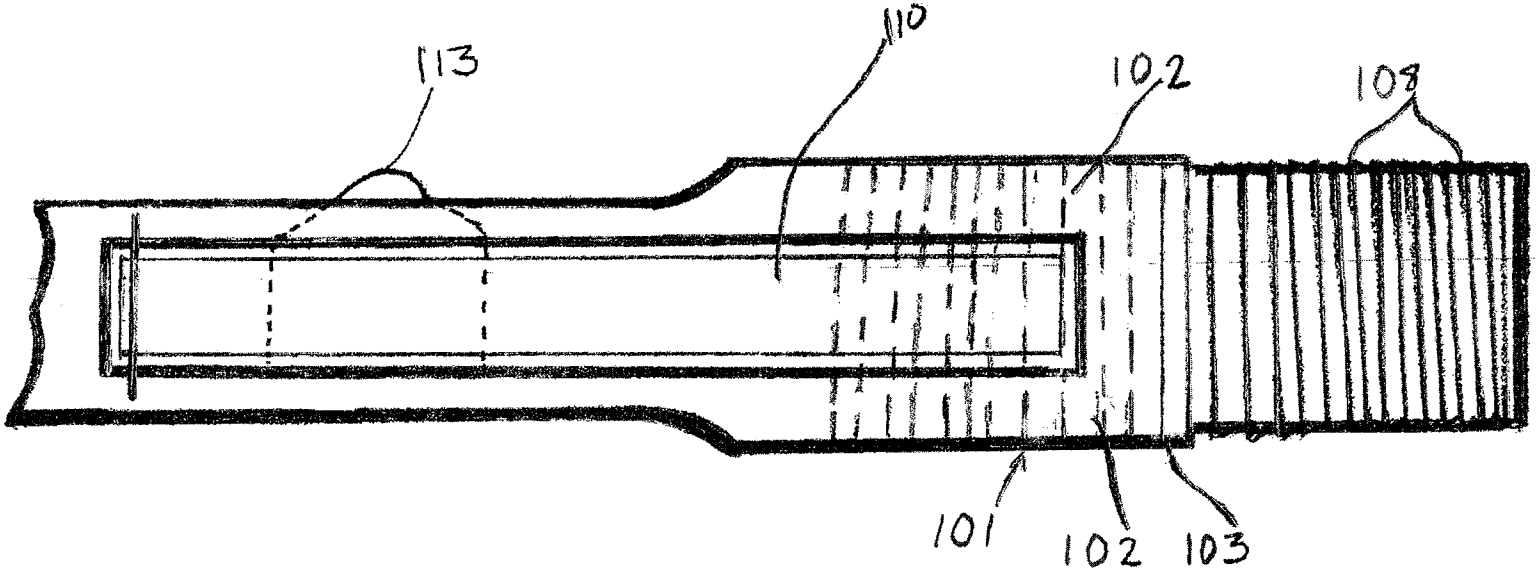
FIG. 5 is a partially transparent side elevation view of an end of the first wrench embodiment shown in FIG. 1.

In use, the pawls 110 may be spread apart by manipulating spring-loaded button 113, so as to disengage the pawls 110 from the ratchet wrench head 107, thus freeing ratchet wrench head 107 to rotate in either direction. The button 113 is shown in the spring-biased usual position in FIG. 4 and in the manipulated position in FIG. 3. FIG. 4 illustrates the wrench in ratchet wrench mode and the arrows indicate the direction of rotation for loosening of a nut or bolt. The rotation of the wrench upside down allows the operation of the wrench for tightening.

Figure 6:
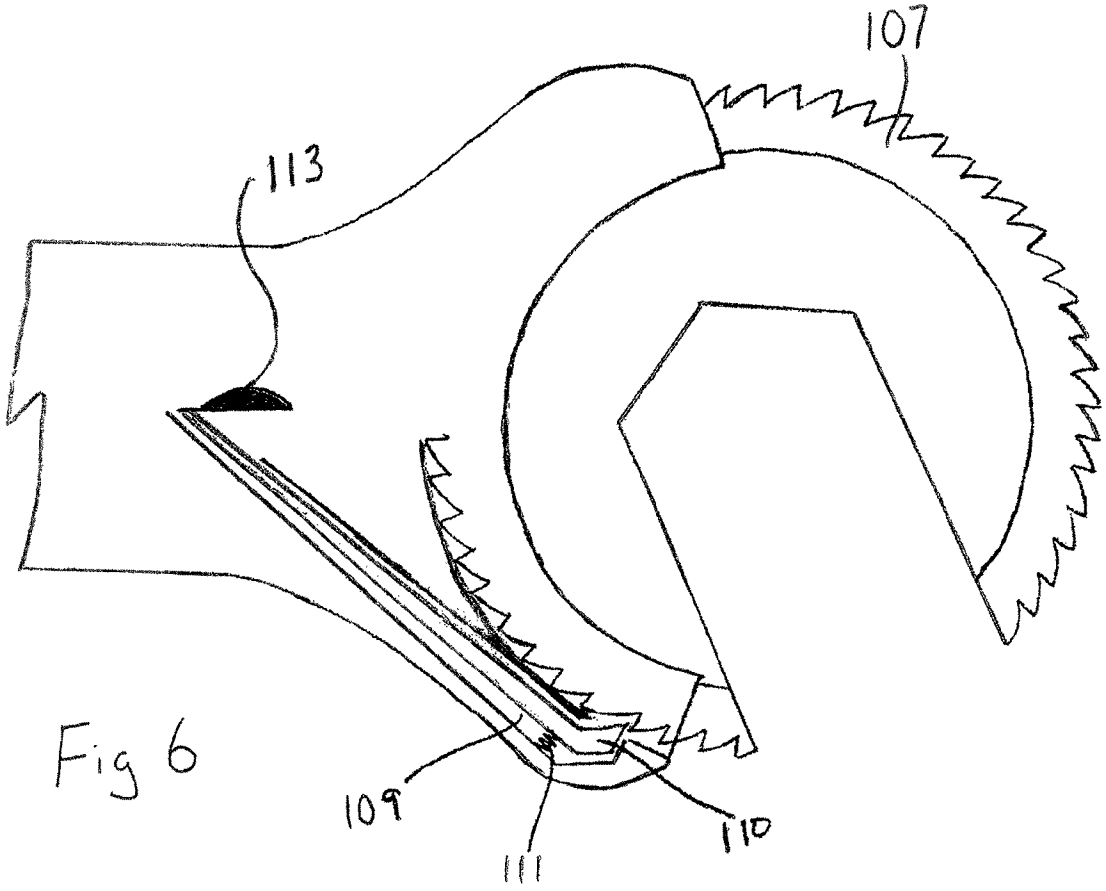
FIG. 6 is a partially transparent plan view of an end of the first wrench embodiment shown in FIG. 1, showing the radial slot rotated to about a 55 degree angle.
Figure 7:
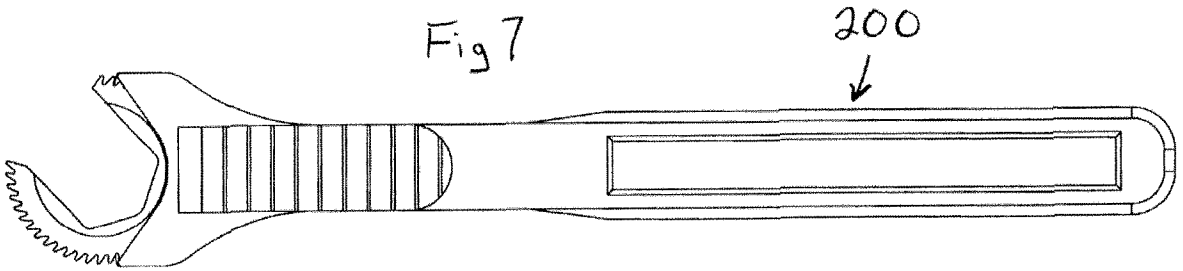
FIG. 7 is a plan view of the knurled cover face of a second wrench embodiment of the present invention.
Figure 8:
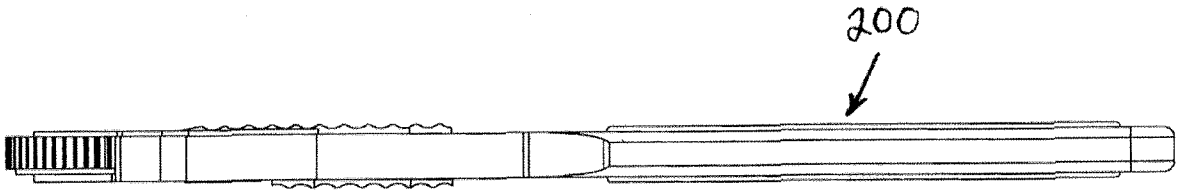
FIG. 8 is a side elevation view of the embodiment shown in FIG. 7.
Figure 9:
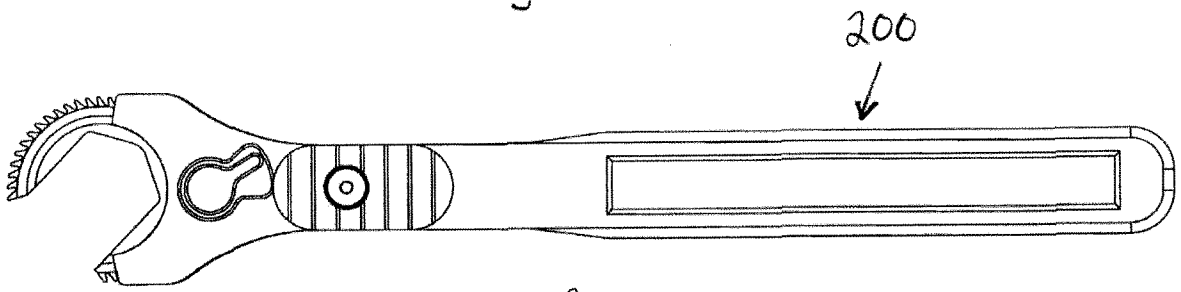
FIG. 9 is a plan view of the knurled slider face of the embodiment shown in FIG. 7.
Figure 10:
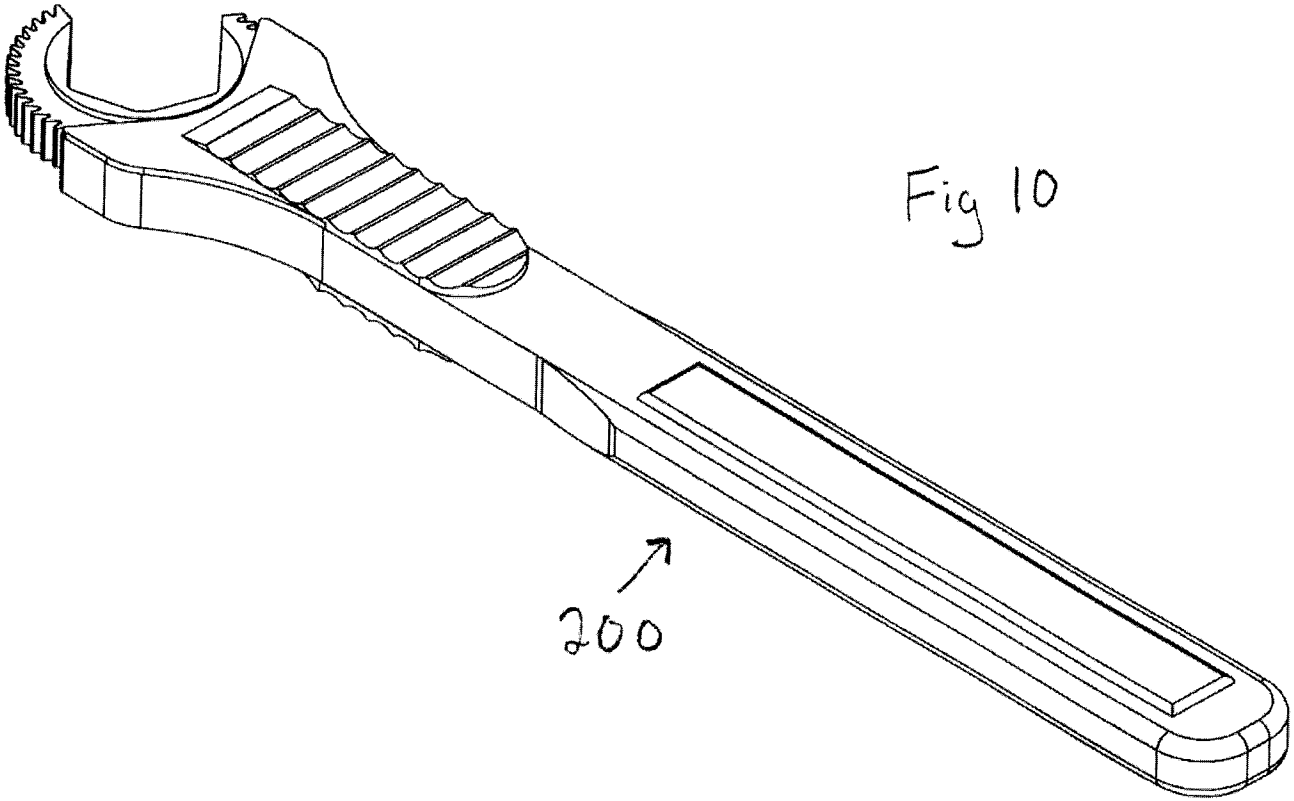
FIG. 10 is a perspective view of the knurled cover face and side of the embodiment shown in FIG. 7, with the view generally towards the grip end of the embodiment.
Figure 11:
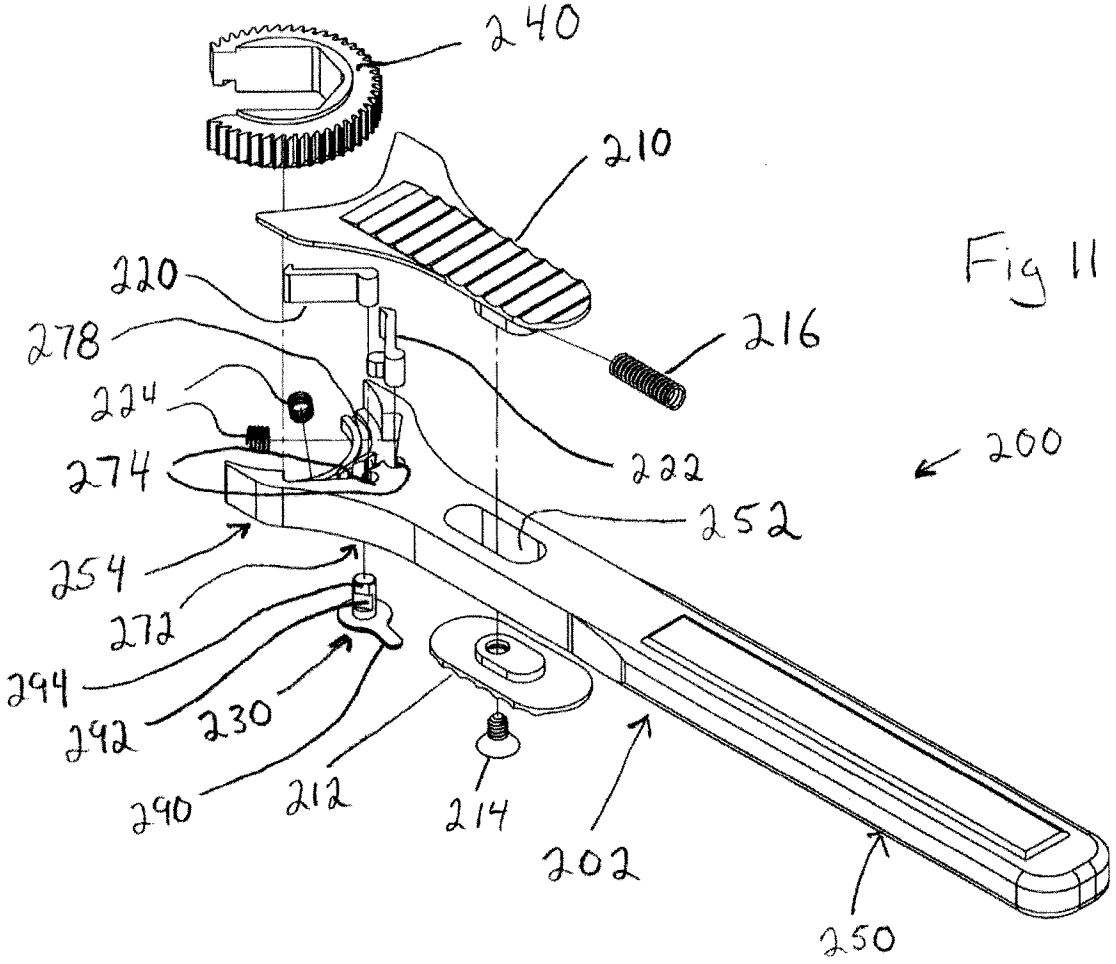
FIG. 11 is an exploded perspective view of the embodiment shown in FIG. 7, with the view generally towards the grip end of the embodiment.
Figure 17:
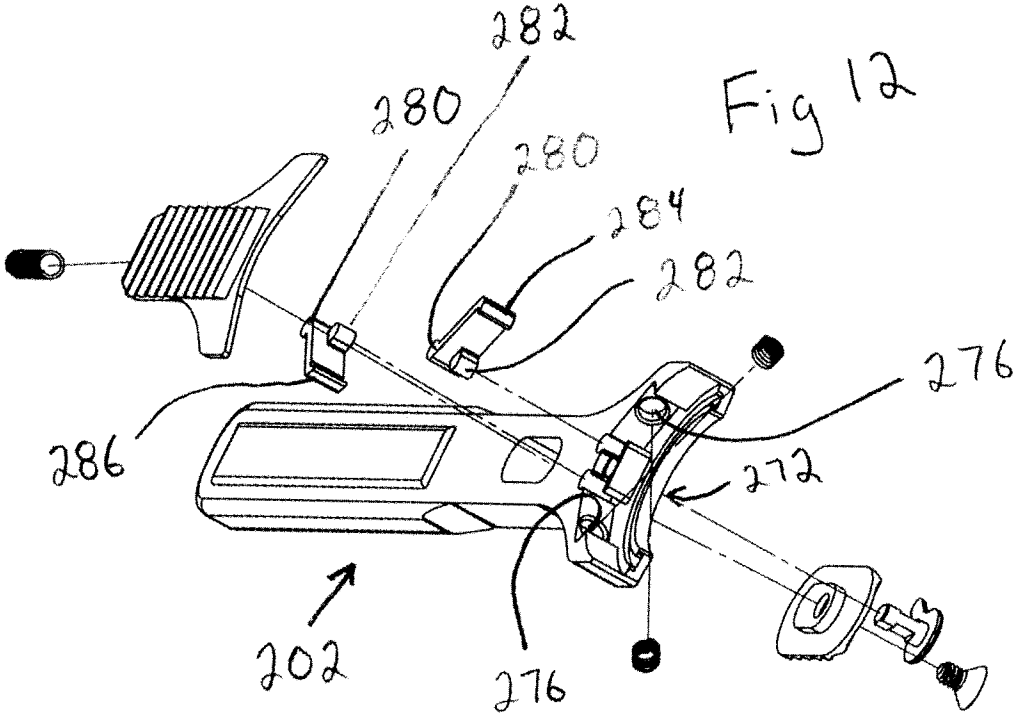
FIGS. 17-19 are plan views of the knurled cover face of the embodiment shown in FIG. 7, showing a small jaws (FIG. 17), a medium jaws (FIG. 18) and a large jaws (FIG. 19).
Figure 13:
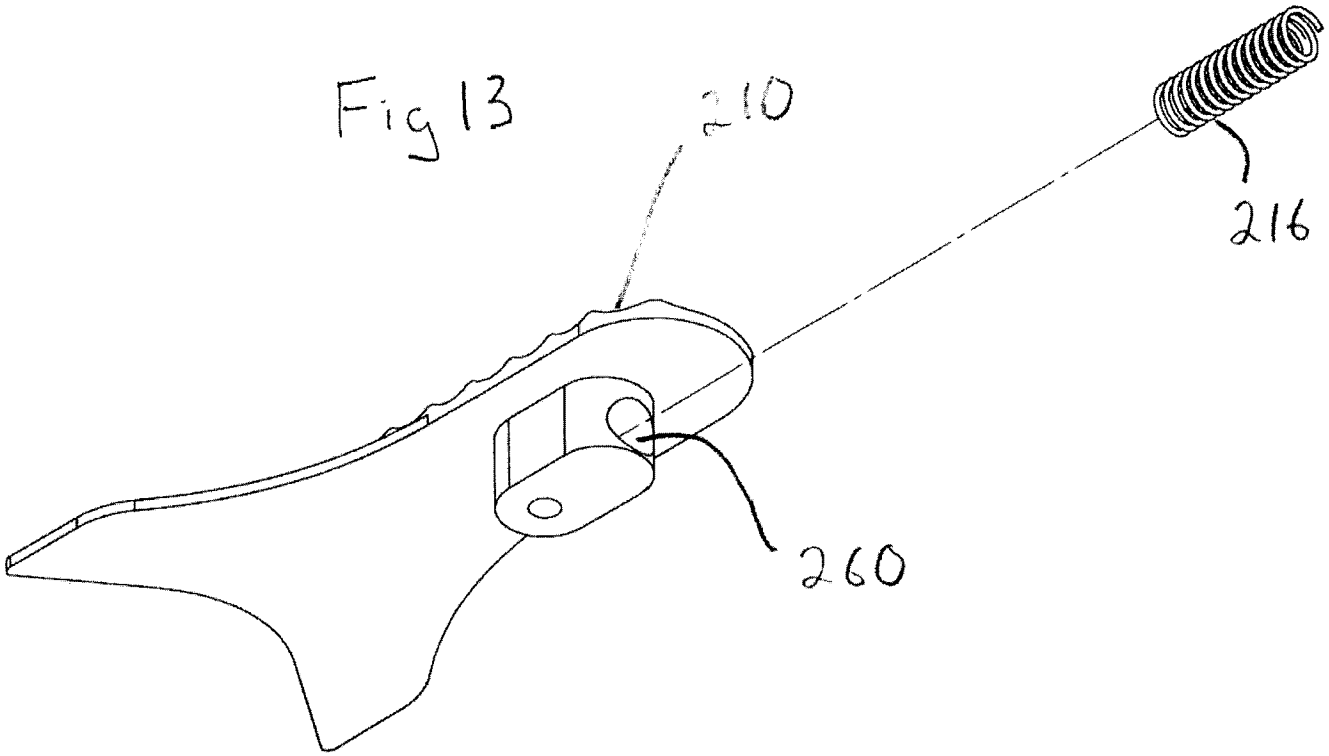
FIG. 13 is an isolation exploded perspective view showing the knurled cover and cover spring of the embodiment shown in FIG. 7.

As shown in FIG. 6, with the first wrench embodiment, the ratchet wrench head 107 may be rotated to a 55 degree angle while still having a completely exposed and useable radial slot 112. The advantage of the wrench being able to work in this way is that it can be better used in tight spaces where it needs to be engaged with a nut or bolt head at an odd angle.

In some cases, such as for motorists, it is not convenient to carry as many different wrenches as is required. With the afore-described wrench, this is not required. A single wrench body 101 may be provided with a variety of ratchet wrench heads 107 of different sizes and the user may readily change one wrench head 107 for another when desired with no need for other tools to do so.

As shown in FIGS. 7 through 26, a second wrench embodiment 200 includes a wrench body 202, a knurled cover 210, a knurled slider 212, a slider-cover retention screw 214, a cover spring 216, a hooking pawl 220, an abutting pawl 222, two pawl springs 224, and a pawl control 230. The second wrench embodiment 200 also includes a selection of jaws of different sizes, which for purposes of illustration are described and shown herein as large jaws 240, medium jaws 242 and small jaws 244.

The wrench body 202 includes a grip end 250, a slider slot 252 and a working end 254.

The knurled cover 210 and knurled slider 212 are attached one to the other, and thereby slidably engage with the wrench body 202 at the slider slot 252, by the slider-cover retention screw 214. The knurled cover 210 and knurled slider 212 are biased towards the working end 254 by the cover spring 216 which is interposed between the cover spring seat 260 in the knurled cover 210 and the adjacent inner wall of the slider slot 252.

The working end 254 includes a pawl control recess 270, a pawl control hole 272, two pawl seats 274, two pawl spring seats 276 and a jaws retention groove 278. The jaws retention groove 278 is a curve of a constant radius, that is, it defines an arc of a circle.

Each of the pawls 220, 222, has a pawl proximal end 280 configured for pivotal engagement with a respective pawl seat 274. Each of the pawls 220, 222 has a pawl protrusion 282. The hooking pawl 220 has a hooking distal end 284 and the abutting pawl 222 has an abutting distal end 286.

The pawl control 230 includes a pawl lever 290, which in use resides within the pawl control recess 270, and two opposed pawl flats 292 on a pawl control shaft 294. The pawl control shaft 294 extends through the pawl control hole 272. In use, the pawl flats 292 engage the pawl protrusions 282, and the pawl control 230 is retained in location by the engagement with the pawls 220, 222 as biased by the pawl springs 224.

Each of the jaws 240, 242, 244, has a jaws opening 300, a plurality of teeth 302 and a retention ridge 304. Each retention ridge 304 is configured to releasably and slidably mate with the jaws retention groove 278 such that when the retention ridge 304 and jaws retention groove 278 are mated, the jaws 240, 242, 244 may be rotated relative to the wrench body 202, about the arc of the circle defined by the jaws retention groove 278, but relative non-rotational movement of the jaws 240, 242, 244 and wrench body 202 within the plane of the circle defined by the jaws retention groove 278 is impeded by the mating of the retention ridge 304 and jaws retention groove 278.

Figure 14:
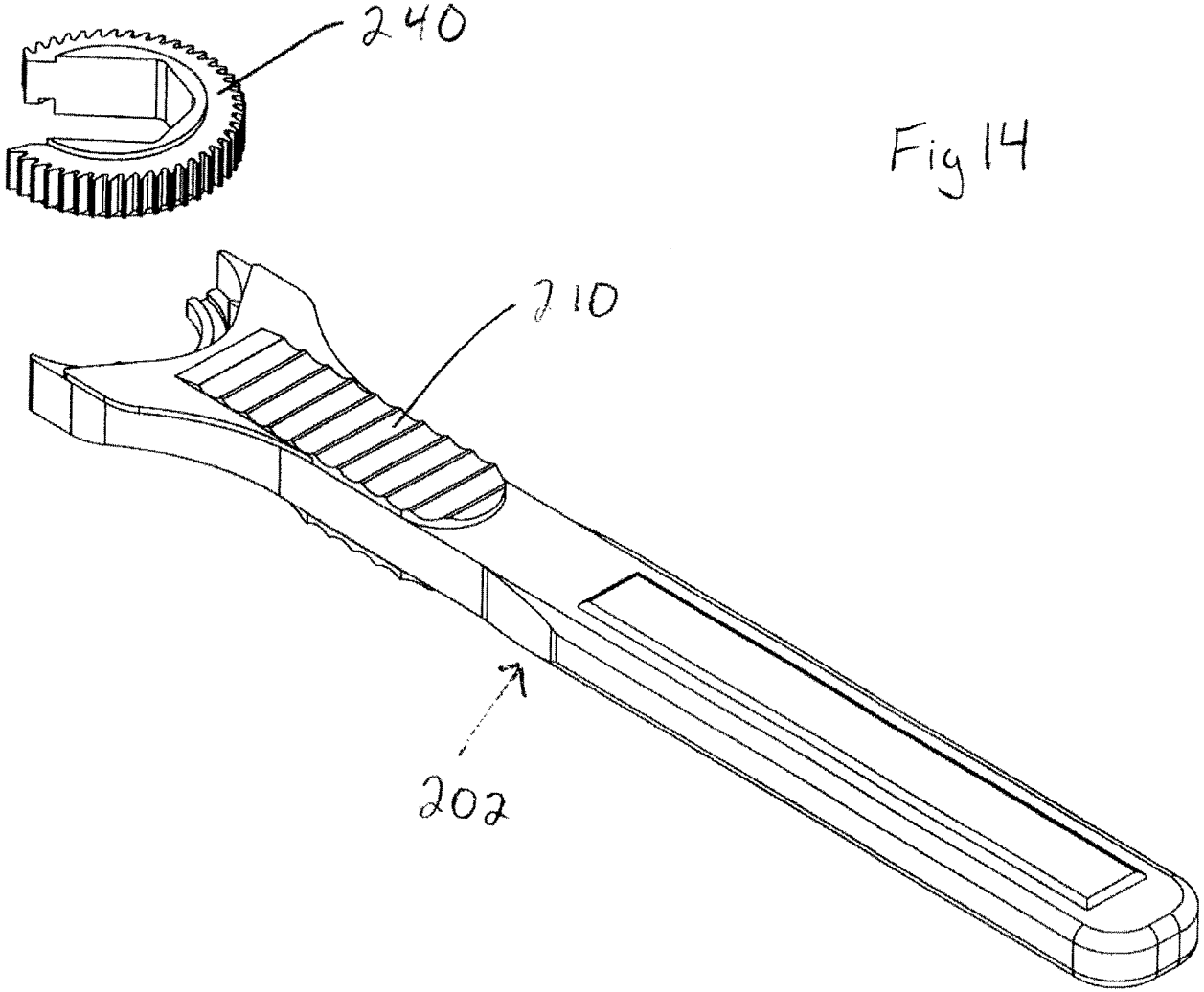
FIGS. 14-16 are perspective views of the knurled cover face and side of the embodiment shown in FIG. 7, with the view generally towards the grip end of the embodiment, showing the knurled cover retracted and a jaws aligned for installation (FIG. 14); the jaws partially installed (FIG. 15); and the jaws fully installed so as to permit the knurled cover to return to the operative position (FIG. 16).
Figure 15:
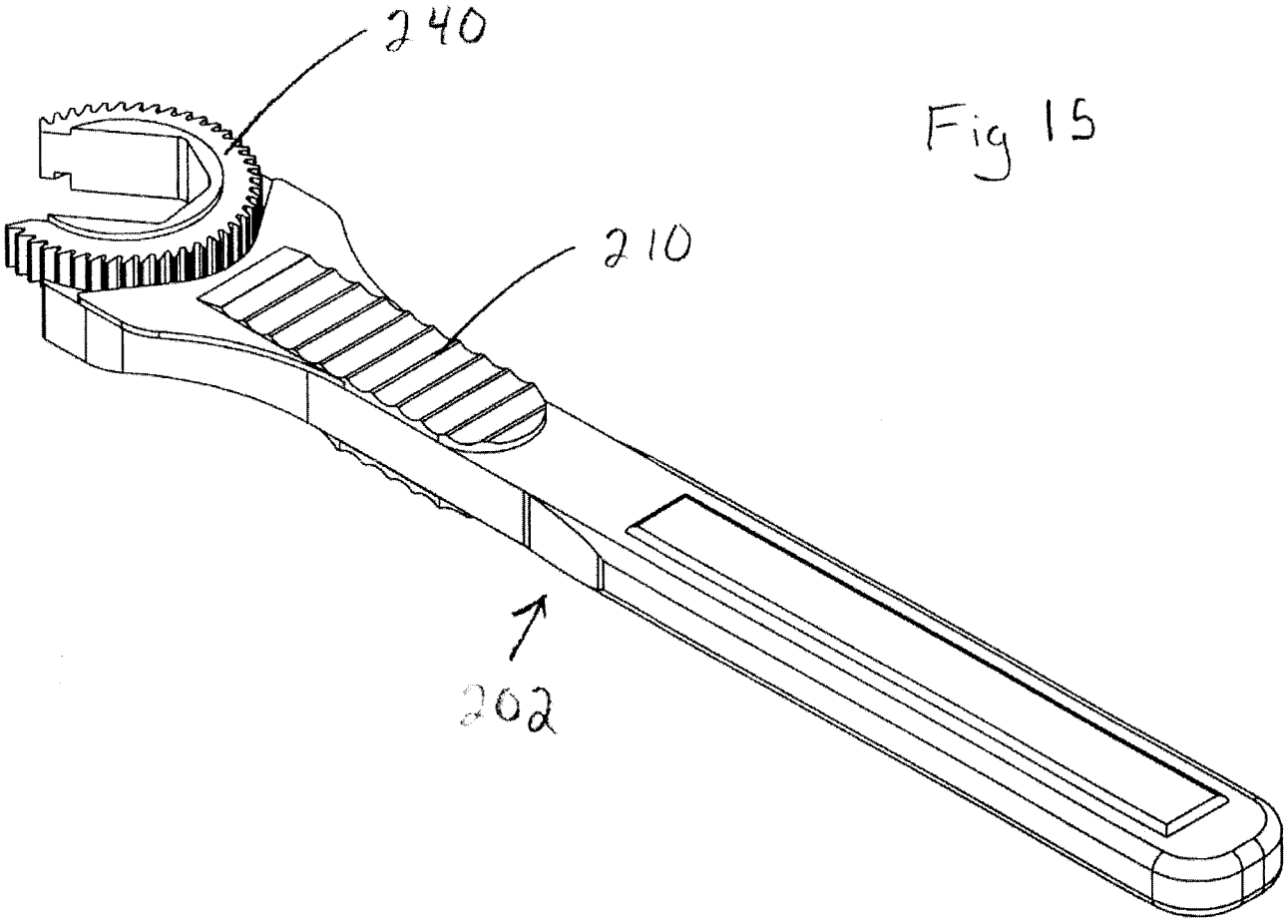
Figure 16:
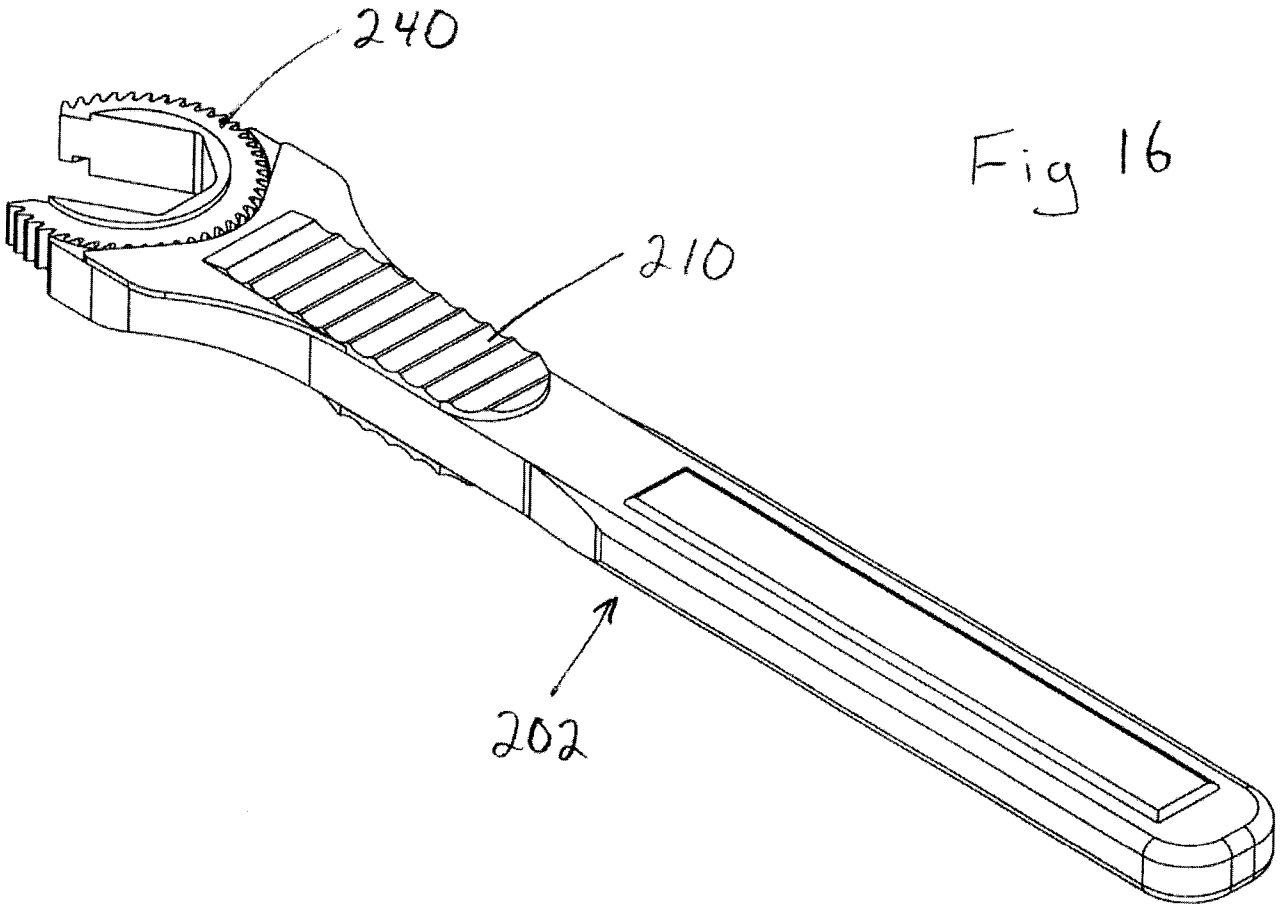
Figures 17, 18, 19:
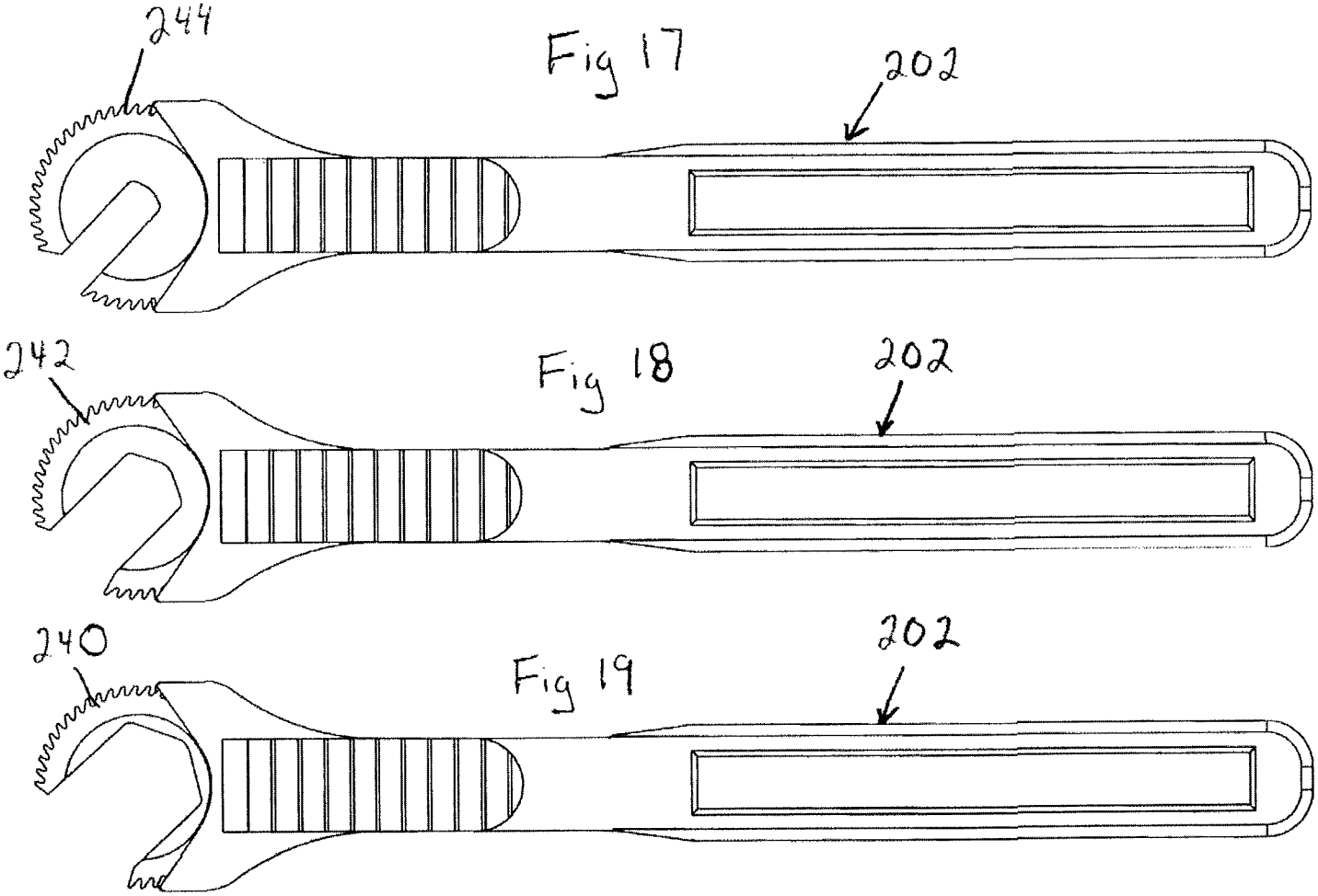

FIGS. 14-16 show stages in the installation of the large jaws 240 (the same stages apply to other jaws 242, 244). To be clear, in FIGS. 14-16 the knurled cover 210 is shown in the retracted position that in normal use would be achieved and maintained against the bias imparted by the cover spring 216, by hand manipulation of the knurled cover 210 or knurled slider 212, but a hand is not shown in the drawings. Once the jaws 240 is in the location shown in FIG. 16, release of the knurled cover 210 or knurled slider 212 would permit the knurled cover 210 to slide (under the bias imparted by the cover spring 216) so as to cover a portion of the jaws 240 and thus retain the jaws 240 in the installed location. Removal of the large jaws 240 is effected by reversal of the above outlined steps.

Figure 20:
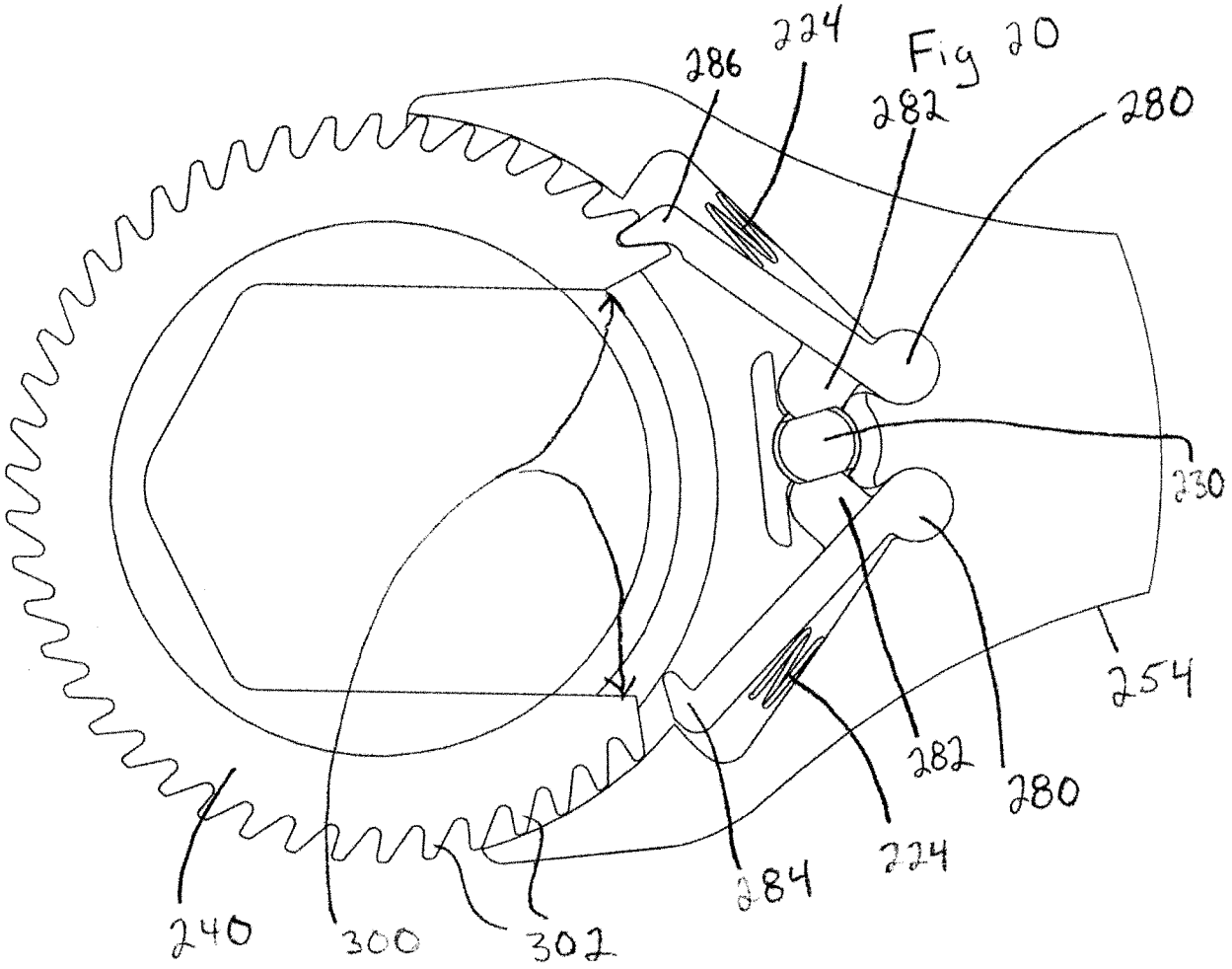
FIGS. 20-22 are transparent isolation plan views showing the working end of the embodiment shown in FIG. 7, illustrating the ratcheting rotational movement and associated pawl positions at the jaw opening of a large jaws.
Figure 21:
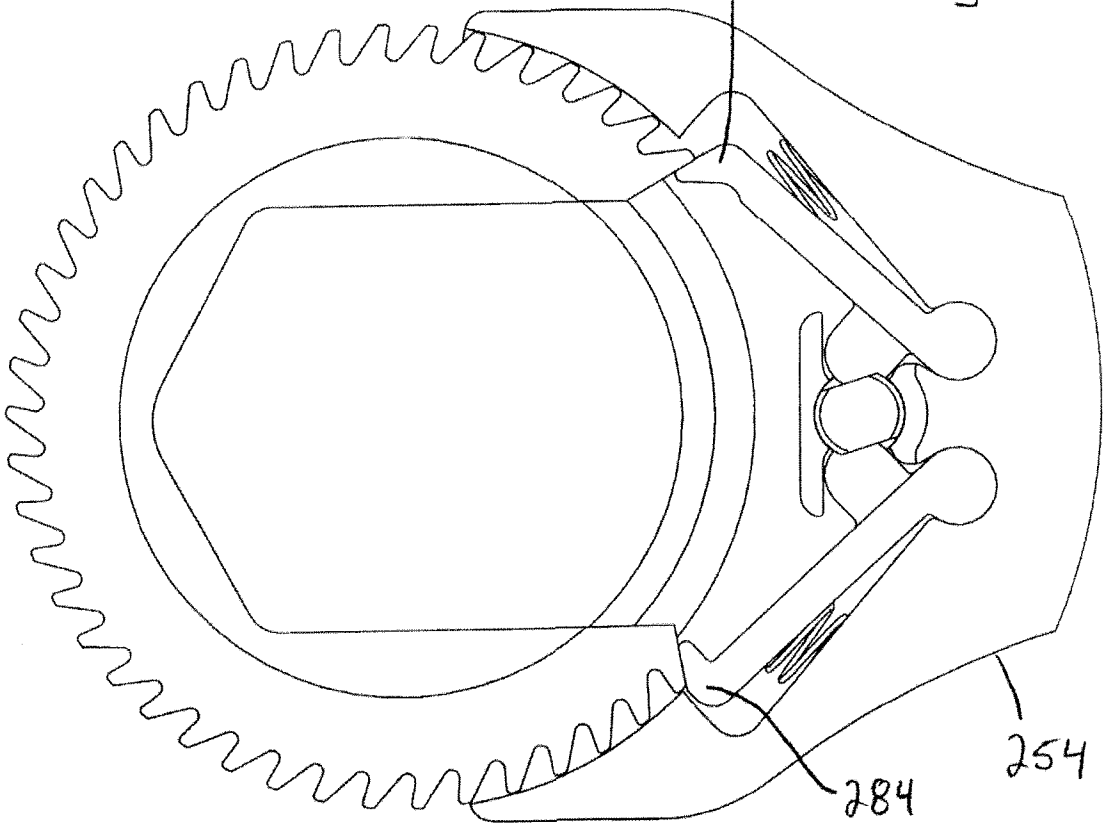
Figure 22:
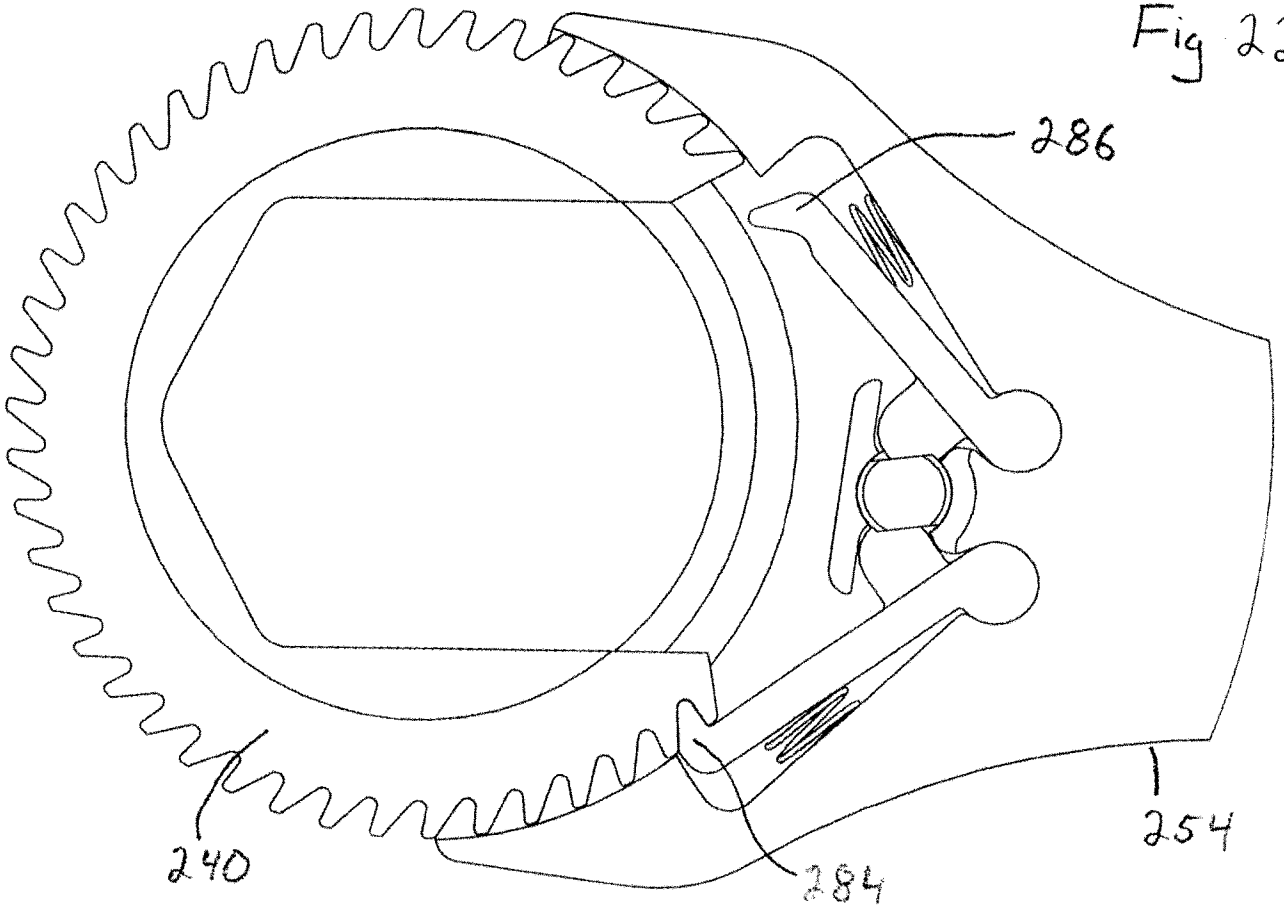

FIGS. 20-22 show the ratcheting rotational movement (being counter-clockwise in FIGS. 20-22) and associated positions of the hooking pawl 220 and abutting pawl 222 at the jaws opening 300 of the large jaws 240, in a sequence of incremental rotational movements, each such movement equivalent to the span between one of the teeth and the next. In FIG. 20, the abutting distal end 286 is interposed between two teeth 302 in a position to impede clockwise rotation of the large jaws 240 and the hooking distal end 284 is not contacting the large jaws 240. In FIG. 21, the abutting distal end 286 is abutting the large jaws 240 adjacent the jaws opening 300 so as to impede clockwise rotation of the large jaws and the hooking distal end 284 is abutting the large jaws 240 (though not so as to impede clockwise rotation of the large jaws 240. In FIG. 22, the abutting distal end 286 is not contacting the large jaws 240 and the hooking distal end 284 is interposed between two teeth 302 in a position to impede clockwise rotation of the large jaws 240.

Figure 23:
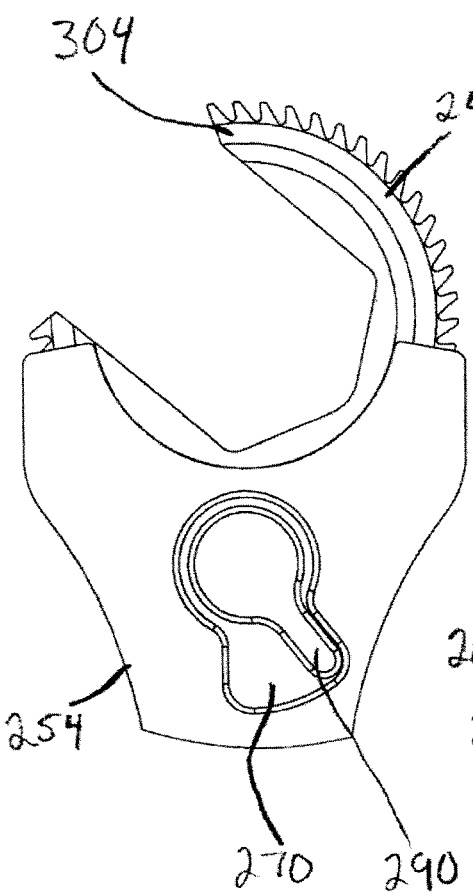
FIG. 23 is an isolation plan view of the knurled slider face of the embodiment shown in FIG. 7, showing the working end with the pawl control in the operative position.
Figure 24:
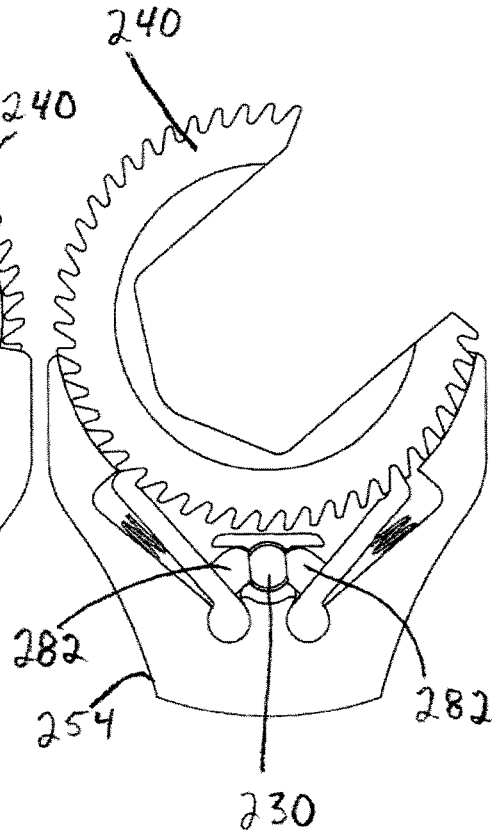
FIG. 24 is a transparent isolation plan view of the knurled cover face of the working end as shown in FIG. 23.
Figure 25:
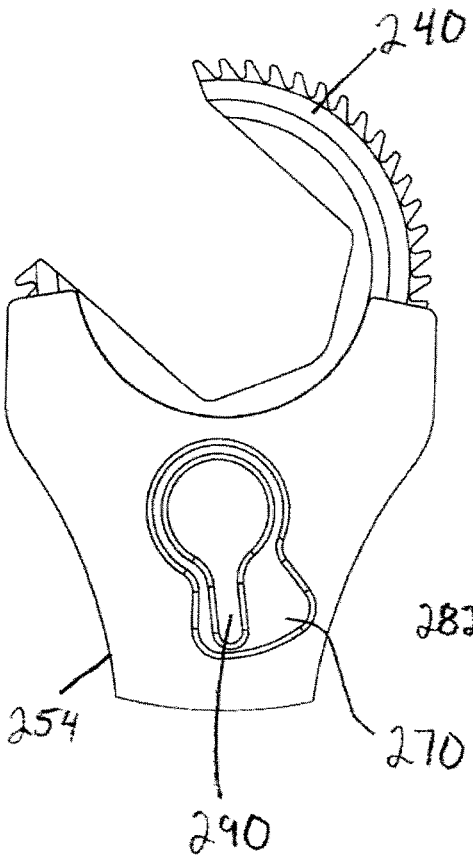
FIG. 25 is an isolation plan view of the knurled slider face of the embodiment shown in FIG. 7, showing the working end with the pawl control in the disengaged position.
Figure 26:
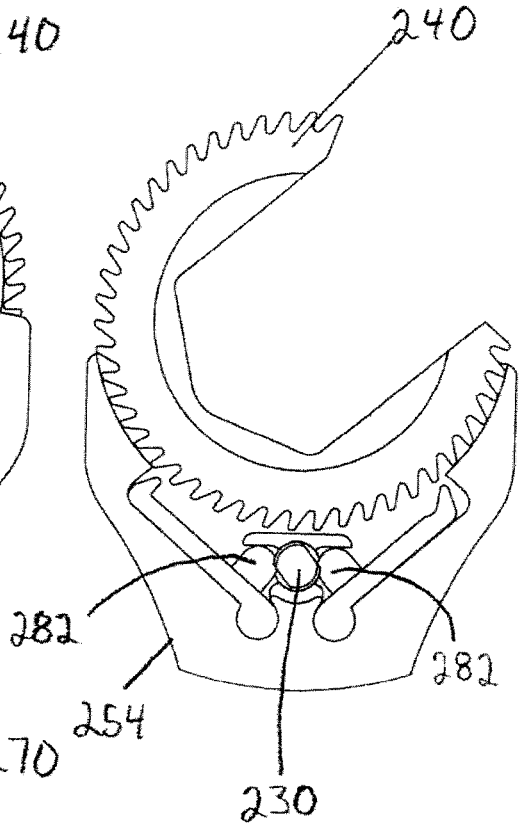
FIG. 26 is a transparent isolation plan view of the knurled cover face of the working end as shown in FIG. 25.

FIGS. 23 to 26 show the operation of the pawl control 230, with the large jaws 240 installed in the working end 254. In FIGS. 23 and 24, the pawl control 230 and pawls 220, 222 are in the ratcheting position, in which the pawl springs 224 cause the pawls 220, 222 to be resiliently engaged with the teeth 302, so as to permit rotation of the large jaws 240 relative to the working end 254 in one direction and impede rotation in the other direction. In FIGS. 25 and 26, the pawl control 230 has been moved, (in use, this movement would be by hand manipulation of the pawl lever 290), so as to cause the pawl flats 292 to rotate relative to the pawl protrusions 282, thus pivoting the pawls 220, 222 away from engagement with the teeth 302 (and compressing the pawl springs 224), such that rotation of the large jaws 240 in either direction is not impeded by the pawls 220, 222.

What is claimed is:

1. A ratchet wrench assembly for use with rotatable fittings, the wrench assembly comprising:

a plurality of interchangeable wrench heads, each wrench head having:

a head arcuate mating feature;

teeth arrayed about a periphery of the wrench head; and a fitting engagement opening; and a wrench body having:

an open end, a body arcuate mating feature to removably receive in operable rotatable communication the head arcuate mating feature of one of the wrench heads when the wrench head is in a working position, such that the wrench head is rotatable relative to the wrench body about an axis of rotation defined by the arcuate mating feature allowing the open end to align with the fitting engagement opening on the wrench head, and movement of the wrench head is impeded in one direction along the axis of rotation and laterally with respect to the axis of rotation; and a cover affixed to the wrench body and resiliently biased in a head retention position in which the cover overlies the wrench head in the working position to impede movement of the wrench head relative to the wrench body along the axis of rotation, the cover being hand manipulable from the head retention position, in a plane of movement to which the axis of rotation is substantially normal, to a position in which the cover does not overlie the wrench head in the working position to permit the installation and removal of the wrench head from the working position of the wrench body; and a ratchet assembly configured to permit rotation of the wrench head in the working position relative to the wrench body in one direction about the axis of rotation and impede rotation in the other direction, the ratchet assembly comprising two longitudinally extending pawls, each having a pawl end configured for engagement with the teeth and a pivot end opposite the pawl end, wherein the two pivot ends are pivotally mounted to the wrench body proximate to one another such that the pawls together define a generally V configuration, each pawl being resiliently and independently biased with respect to the wrench body to bring the pawl end into engagement with the teeth of the wrench head in the working position; and a longitudinally movable pawl spreader having a variable lateral dimension, the pawl spreader being interposed between the pawls in the vicinity of the pivot ends such that manual longitudinal movement of the pawl spreader in a release direction brings a larger lateral dimension of the pawl spreader into contact with the pawls, thus spreading the pawls against the resilient biasing of the pawls and disengages both pawls from the teeth, so as to permit the wrench head in the working position to rotate relative to the wrench body in either direction about the axis of rotation, and wherein the resilient biasing of each pawl with respect to the wrench body causes the pawls to reengage the teeth when the pawl spreader is moved opposite to the release direction.

2. The ratchet wrench assembly as defined in claim 1, wherein the ratchet assembly is manually releasable whereby when the ratchet assembly is released the wrench head in the working position is permitted to rotate relative to the wrench body in either direction about the axis of rotation.

3. The ratchet wrench assembly as defined in claim 1, wherein each pawl is resiliently biased with respect to the wrench body by a spring interposed between the pawl and the wrench body.

4. The ratchet wrench assembly as defined in claim 1, wherein the wrench body is longitudinally extending and the hand manipulable movement of the cover is linear and generally aligned with the longitudinal extent of the wrench body.

5. The ratchet wrench assembly as defined in claim 4, wherein the wrench body has a slot therethrough; and the cover is affixed to the wrench body by means of a cover sub-member extending through the slot, wherein the cover may be moved by hand manipulation of the cover on one side of the wrench body or by manipulation of the cover sub-member on an opposite side of the wrench body.

6. The ratchet wrench assembly as defined in claim 4, wherein the cover is resiliently biased in the head retention position by a spring within the slot.

7. The ratchet wrench assembly as defined in claim 1, wherein the fitting engagement opening of each wrench head comprises two opposed planar surfaces suitable for engaging fittings with conventional parallel outward facing planar surfaces.

8. The ratchet wrench assembly as defined in claim 1, wherein the head arcuate mating feature of each wrench head comprises an arcuate ridge and wherein the body arcuate mating feature comprises an arcuate channel.

9. A ratchet wrench assembly for use with rotatable fittings, the wrench assembly comprising: a wrench body having: an open end, a body arcuate mating feature to removably receive in operable rotatable communication the head arcuate mating feature of one of the wrench heads when the wrench head is in a working position, such that the wrench head is rotatable relative to the wrench body about an axis of rotation defined by the arcuate mating feature allowing the open end to align with the fitting engagement opening on the wrench head, and movement of the wrench head is impeded in one direction along the axis of rotation and laterally with respect to the axis of rotation; and a ratchet assembly configured to permit rotation of the wrench head in the working position relative to the wrench body in one direction about the axis of rotation and impede rotation in the other direction, the ratchet assembly comprising two longitudinally extending pawls, each having a pawl end configured for engagement with the teeth and a pivot end opposite the pawl end, wherein the two pivot ends are pivotally mounted to the wrench body proximate to one another such that the pawls together define a generally V configuration, each pawl being resiliently and independently biased with respect to the wrench body to bring the pawl end into engagement with the teeth of the wrench head in the working position; and a longitudinally movable pawl spreader having a variable lateral dimension, the pawl spreader being interposed between the pawls in the vicinity of the pivot ends such that manual longitudinal movement of the pawl spreader in a release direction brings a larger lateral dimension of the pawl spreader into contact with the pawls, thus spreading the pawls against the resilient biasing of the pawls and disengages both pawls from the teeth, so as to permit the wrench head in the working position to rotate relative to the wrench body in either direction about the axis of rotation, and wherein the resilient biasing of each pawl with respect to the wrench body causes the pawls to reengage the teeth when the pawl spreader is moved opposite to the release direction.

10. The ratchet assembly for use with rotatable fittings as defined in claim 9, wherein the distal end region of said first pawl comprises a hooking distal end and the distal end region of said second pawl comprises an abutting distal end, said hooking distal end and said abutting distal end being manually releasable from said teeth by spreading a V-shaped configuration of the first and second pawls from the working position to a wrench head free rotating position, wherein the wrench head is able to freely rotate in either direction relative to the wrench body in a direction towards said first or said second pawl.

11. The ratchet assembly for use with rotatable fittings as defined in claim 10, further comprising the first and second pawls include adjacent proximal ends; and wherein the longitudinally movable pawl spreader is manually operable and interposed between said first and second pawls near said proximal end regions for spreading said hooking distal end and said abutting distal end between said working position and said wrench head free rotating position.

12. The ratchet assembly for use with rotatable fittings as defined in claim 11, wherein said pawl spreader has a variable lateral dimension adjacent to said first and second pawl such that manual rotation of said longitudinally movable pawl spreader brings a larger dimension of said pawl spreader into contact with said first and second pawls so as to spread the V-shape configuration to said wrench head free rotating position and release said hooking distal end and said abutting distal end from said spaced-apart teeth.

13. The ratchet assembly for use with rotatable fittings as defined in claim 11, wherein said first and second pawls each further comprise projections for each communicating with opposed directories of said larger dimension as said manually operable pawl spreader is rotated so as to effect spreading of said V-shape configuration.

14. The ratchet assembly for use with rotatable fittings as defined in claim 11, wherein said resilient biasing of said distal end regions tends to cause said longitudinally movable pawl spreader to move such that said hooking distal end and said abutting distal end move to said working position once a user ceases manipulation of said longitudinally movable pawl spreader.

15. The ratchet assembly for use with rotatable fittings as defined in claim 9, wherein said resilient bias of said distal end regions is provided by a first spring in communication said first pawl and second spring in communication with said second pawl, each of said first and second springs respectively interposed between said first and second pawls and said wrench body.

16. The ratchet assembly for use with rotatable fittings as defined in claim 9, further comprising a slidable cover portion coupled to said wrench body and resiliently biased in a wrench head retention position toward the fitting engaging region along an axis in line with said handle portion wherein the cover portion overlies a portion of the wrench head in said working position so as to maintain the wrench head in the working position of the fitting engaging region.

17. The ratchet assembly for use with rotatable fittings as defined in claim 15, wherein sliding said cover portion from said wrench head retention position against said bias to a wrench head installation position permits installation and removal said wrench head to and from the working position of said fitting engaging region.

18. The ratchet assembly for use with rotatable fittings as defined in claim 16, wherein sliding said cover portion from said wrench head retention position to said wrench head installation position permits installation of said wrench head is hand manipulable.

19. The ratchet assembly for use with rotatable fittings as defined in claim 16, wherein said handle portion includes a slot, and said cover portion being coupled to said handle portion by a cover portion sub-member extending through said slot, and hand manipulable between said wrench head retention position and said wrench head installation position by sliding said cover portion.

20. The ratchet assembly for use with rotatable fittings as defined in claim 13, wherein said cover portion is resiliently biased in said wrench head retention position by a spring located in said slot.

* * * * *